US005273780A

United States Patent [19]

Borger et al.

[11] Patent Number: 5,273,780

[45] Date of Patent: Dec. 28, 1993

[54] SCREEN PRINTING A GLASS PANE WITH A DECORATIVE COATING INCLUDING BLOWING AWAY OR SUCKING PRINTING INK FROM THE EDGE OF THE GLASS PANE

[75] Inventors: Manfred Borger, Aachen; Dieter Hahn, Ubach-Palenberg, both of Fed. Rep. of Germany

[73] Assignee: Saint-Gobain Vitrage International, Courbevoie, France

[21] Appl. No.: 856,368

[22] Filed: Mar. 23, 1992

[30] Foreign Application Priority Data

Mar. 23, 1991 [DE] Fed. Rep. of Germany ..... 4109707

[51] Int. Cl.[5] ..... B05D 5/06

[52] U.S. Cl. ..... 427/163; 427/282; 427/287; 427/294; 101/123; 101/129; 118/413

[58] Field of Search ..... 427/282, 294, 287, 163, 427/165; 101/114, 123, 124, 126, 129; 118/213, 406, 413

[56] References Cited

U.S. PATENT DOCUMENTS

| | | | |
|---|---|---|---|
| 4,102,266 | 7/1978 | Porth | 101/124 |
| 4,121,519 | 10/1978 | Porth | 101/123 |
| 4,433,623 | 2/1984 | Beckim | 101/123 |

FOREIGN PATENT DOCUMENTS

| | | | |
|---|---|---|---|
| 1081480 | 5/1960 | Fed. Rep. of Germany | 101/123 |
| 1264380 | 3/1968 | Fed. Rep. of Germany | 101/123 |

*Primary Examiner*—Terry J. Owens

*Attorney, Agent, or Firm*—Oblon, Spivak, McClelland, Maier & Neustadt

[57] ABSTRACT

In the application of a decorative coating onto a glass pane by the silk screen printing process, a printing screen (2) is used, the printing surface of which extends beyond the peripheral face (9) of the glass pane (1). The printing ink situated in the meshes of the printing screen outside the glass surface in the printing operation is blown away or is sucked away by a suction nozzle (23), which is guided over the printing screen (2) behind the scraper (21).

8 Claims, 2 Drawing Sheets

SCREEN PRINTING A GLASS PANE WITH A DECORATIVE COATING INCLUDING BLOWING AWAY OR SUCKING PRINTING INK FROM THE EDGE OF THE GLASS PANE

BACKGROUND OF THE INVENTION

1. Field of the Invention

This invention relates to a method of applying a decorative coating onto a glass pane by the screen printing process, wherein the decorative coating, at least in a selected region, is applied right up to the peripheral edge of the glass pane. The invention relates also to devices for carrying out the method.

2. Description of the Related Art

Automobile glazing panes are frequently provided along one edge or along the entire periphery thereof with a decorative coating, usually of a baking finish. This decorative coating has, amongst other things, the function of protecting the adhesive film by which the glass panes are fixed in the frame from UV radiation. For applying the decorative coating onto the glass surface, the silk screen printing process has proved especially suitable. The printing ink is usually baked in at temperatures of 550 to 600 degrees Celsius or higher in the course of the heat treatment required for the curving and/or toughening of the glass panes.

The glass panes in the installed condition are now frequently no longer covered by a profiled frame encompassing the pane at the edge or fitting over the edge, but instead the glass panes are visible from the outside right up to their edges. This means that the decorative print at the edge is also visible right up to the periphery of the glass pane. Irregularities in the outer boundary of the decorative coating, especially slightly differing distances between the outer boundary of the decorative coating and the edge of the glass pane, can have a very adverse appearance. Furthermore, in the regions that are free of the decorative coating, the protection of the adhesive film from ultraviolet radiation is no longer provided. A considerable interest therefore exists in being able to print the colored coating forming the decorative coating in selected regions or along the entire periphery of the glass pane, right up as far as the peripheral edge.

In the usual printing processes, especially in screen printing, it is difficult for various reasons to carry out an exact color application accurately right up to the edge of the glass pane. The glass panes as a rule have certain admissible dimensional tolerances, whereas they are all printed using the same printing screen. The positioning operations of the glass panes to be printed and of the printing tools are also accompanied by tolerances, which may be additive to the dimensional tolerances of the glass panes. If the part of the printing screen permeable to the printing ink projects beyond the edge of the glass pane, the printing ink adheres in the meshes of the printing screen and on the underside of the printing screen at these locations, which leads to unclear printed images in the succeeding printing operations. To overcome this difficulty, therefore, the application of the color in the screen printing process is usually performed only up to a distance from the edge of the pane which allows for the most unfavorable case.

It is known to obtain, by the screen printing process, a decorative coating extending up to the edge of the pane by laying templates complementary to the shape of the glass pane against the pane and carrying out the color application beyond the edge of the pane and onto the surfaces of these templates, which are then removed from the glass pane (U.S. Pat. No. 4,268,545). When the templates are removed from the glass pane edge, however, the printed ink has not yet dried and can foul the peripheral face of the glass pane. Furthermore, the printing ink on the templates has not yet dried at the next succeeding printing operation and transfers onto the lower face of the printing screen.

SUMMARY OF THE INVENTION

An object of the present invention is further to develop the silk screen printing process so that the printing of glass panes with decorative coatings extending right to the peripheral edge is made possible independently of the unavoidable border tolerances of the glass panes and of the printing screen and also of the positional tolerances of the glass panes and of the printing screen, without a risk of fouling of the printing screen and the peripheral faces of the glass panes by the printing ink. The method shall be suitable for use in the series production of printed glass panes.

According to this invention this object is achieved in that a printing screen having a printing area extending beyond the edge of the glass pane is used, and the printing ink situated in the printing screen outside the glass surface in the printing operation is removed from the meshes of the printing screen by a pneumatic pressure differential.

In this invention, therefore, the printing screen is so constructed that the printing area, even in the most unfavorable case of dimensional tolerances and of positioning conditions, extends beyond the edge of the glass pane. In this way it is ensured that he printing ink in every case is applied onto the glass surface right up to the edge of the pane. The ink forced through the meshes of the printing screen outside the glass surface is rendered harmless by being entrained away by an upwardly flowing air stream, so that the printing screen is free of printing ink after a printing operation which extends outside the glass area. The air stream also prevents the peripheral faces of the glass panes from being wetted with printing ink.

According to a first embodiment of the invention, the pneumatic differential pressure outside the peripheral face of the glass pane is created either by producing a static excess pressure beneath the printing screen or by causing an air stream to act from below on the printing screen. This can be carried out simultaneously with the printing operation, or immediately after it provided that the printing screen is still situated on the glass pane.

According to a second preferred embodiment, the pneumatic differential pressure is created by means of a suction nozzle which is guided over the printing screen after the printing ink has been scraped across the upper face of the printing screen.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
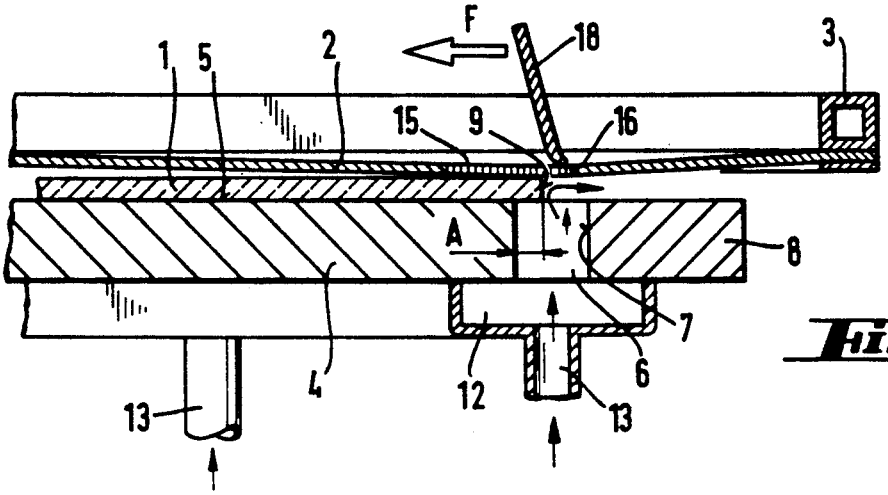
FIG. 1 shows a screen printing apparatus having an overpressure duct in the supporting table in the vicinity of the pane perimeter, in vertical section at the edge region of the glass pane.
Figure 2:
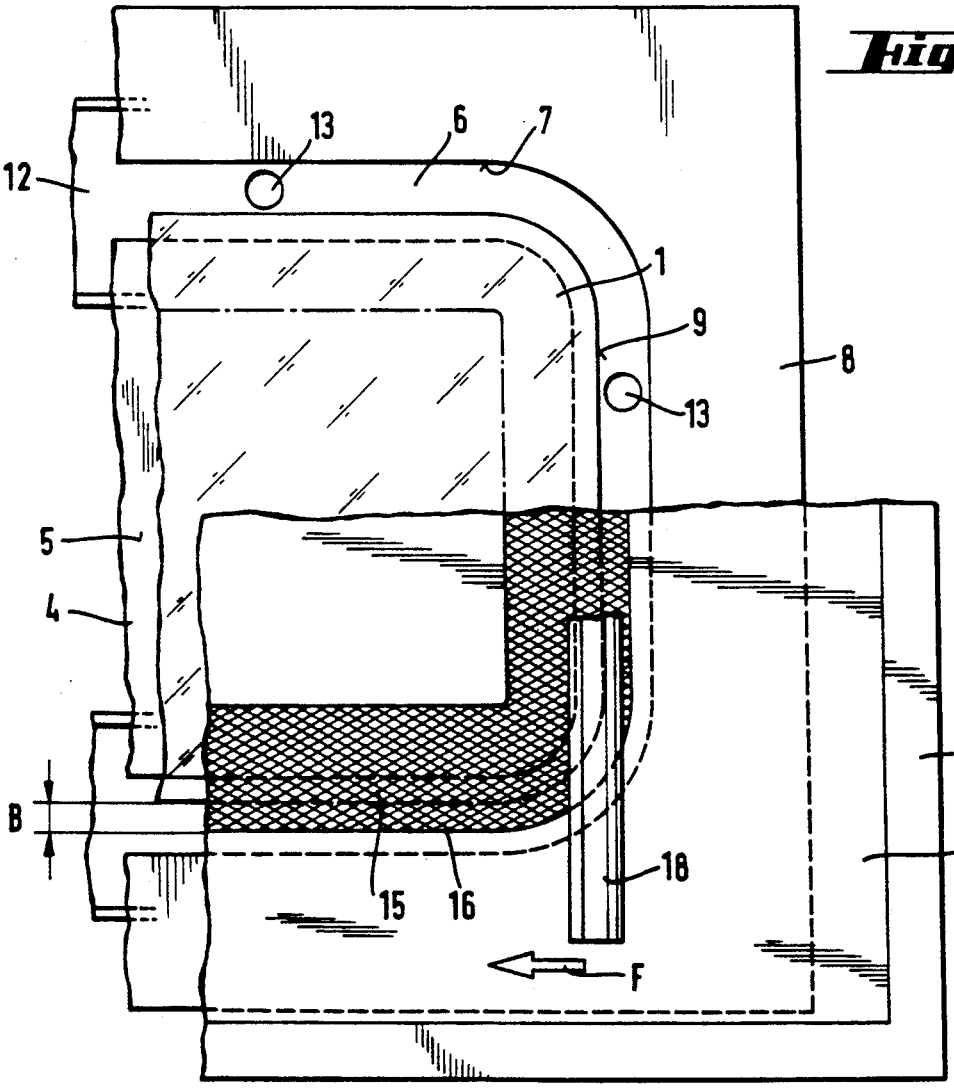
FIG. 2 shows a plan of the apparatus illustrated in FIG. 1.

By means of the screen printing device illustrated in FIGS. 1 and 2, the method of this invention may be carried out in that the printing screen, outside the glass pane 1 to be printed, is kept free of the printing ink or cleansed of the printing ink by overpressure acting from below against the printing screen 2.

During the printing operation, the glass pane 1 rests on a plane table 4. The actual supporting surface 5 of the table 4 has the shape of the glass pane 1 to be printed, but as a whole is smaller than the glass pane 1, so that the glass pane 1, along its entire periphery, projects by a short distance A beyond the supporting surface 5. The supporting surface 5 of the table is adjoined laterally by a duct 6, which is bounded on its outer side by a wall face 7, which for example can be formed by a plate 8 as an extension of the table plate. The peripheral face 9 of the glass pane lies, during the printing operation, above the duct 6.

Beneath the duct 6 a distributor duct 12 rests on the underside of the table plate 4, which duct 12 possesses feed pipes 13 which are connected to a blower. The ducts 6 and 12 comprise an embodiment of a positive air pressure source. The air supplied through the feed pipes 13 flows vertically upwards inside the duct 6.

The printing screen 2 has a printing area 15, the outer contour 16 of which as a whole is larger than the outer contour of the glass pane 1, as defined by the peripheral face 9. With the usual process conditions and tolerances, it has been found advisable for the excess dimension B from the peripheral face 9 of the glass pane to the outer contour 16 of the printing area 15 to be a few millimeters.

When the printing screen 2, fixed to the frame 3, has been lowered, then as soon as the printing operation commences by the wiper or scraper 18 being pressed onto the printing screen 2 and pulled across the screen printing template 2 in the direction of arrow F, compressed air is fed through the feed pipes 13. The air stream emerging vertically out of the duct 6 flows upwards against the printing screen and prevents the printing ink from issuing downwards out of the meshes of the printing screen in the region of the printing area projecting beyond the peripheral face 9 of the glass pane.

In those cases in which a closed decorative frame is not to be printed onto the glass pane, but, for example, only a decorative strip is to be printed along one edge of the glass pane, the above measures need be taken only in the relevant zone in which the decorative strip is to extend right up to the edge of the glass.

Figure 3:
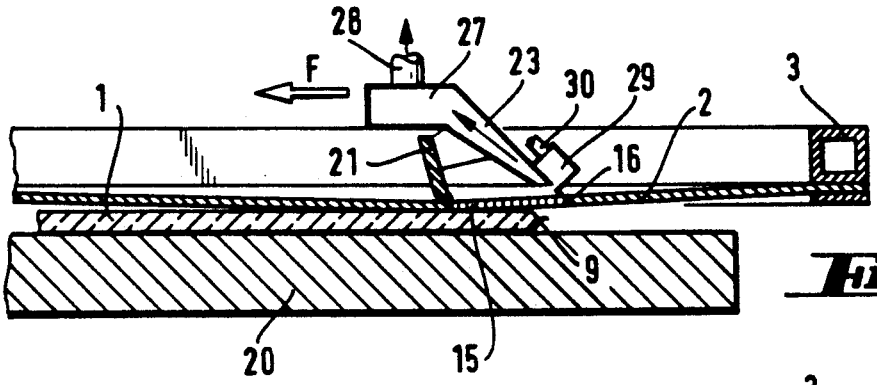
FIG. 3 shows a screen printing apparatus comprising a suction nozzle acting from above on the printing screen, in vertical section in the edge region of the glass pane.
Figure 4:
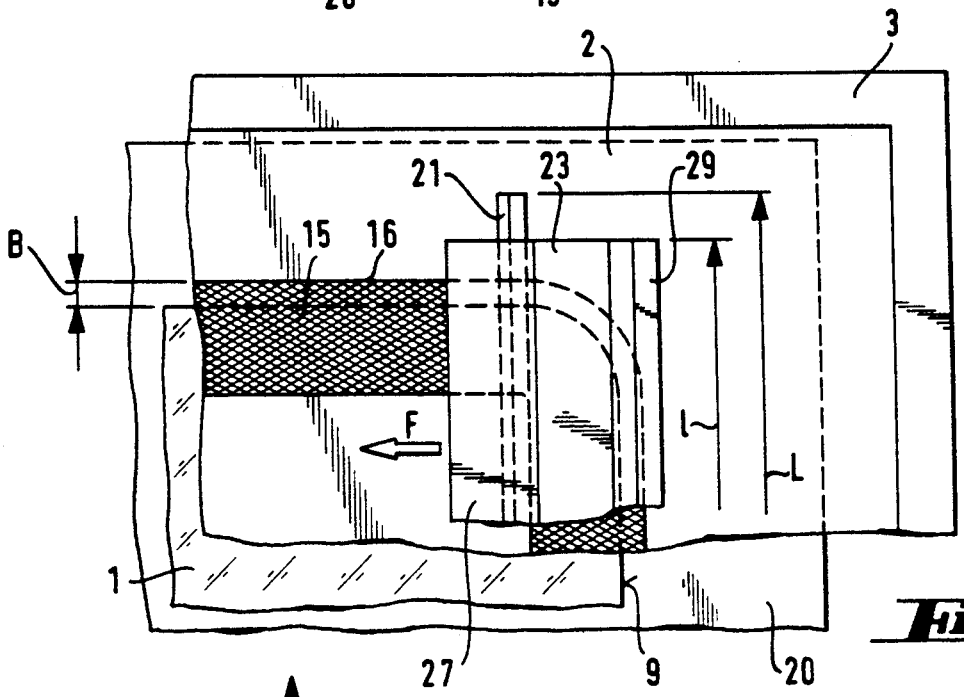
FIG. 4 shows the apparatus shown in FIG. 3 in plan.
Figure 5:
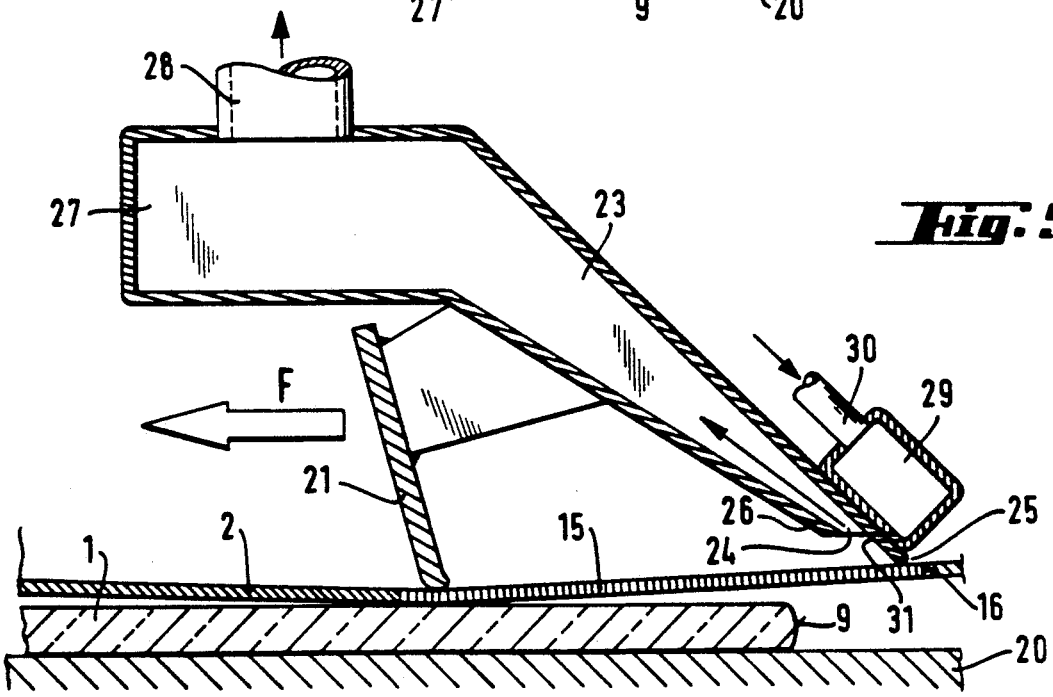
FIG. 5 shows an enlarged view of the mouth region of a suction nozzle with an apparatus for feeding a solvent.

In the embodiment illustrated in FIGS. 3 to 5, the printing ink not printed onto the glass surface is sucked from the upper face of the printing screen. The sucked-away printing ink is collected in a container and can be reused after suitable treatment.

The screen printing device comprises, here again, a plane table 20 on which the glass pane 1 can be laid with suitable positioning. The printing screen 2, fixed to the frame 3, once again has a printing area 15, of which the external contour 16 lies outside the peripheral face 9 of the positioned glass pane 1 by a distance B. By means of the wiper or scraper 21, the printing ink is applied through the printing screen onto the glass surface with movement of the scraper 21 in the direction of arrow F.

By use of the scraper 21, the printing ink is also pressed through the meshes of the printing screen in the region of the printing screen between the peripheral face 9 of the glass pane and the external contour 16 of the printing area 15. The printing ink situated inside the meshes of the printing screen and adhering to the printing screen in this region is sucked away by a slit-shaped nozzle 23 of a sucking device. The slit-shaped nozzle 23 is guided in the same direction as the scraper 21 over the printing screen, the mouth 24 of the nozzle being kept at a distance of a few millimeters above the printing screen. The rear nozzle lip 25 of the slit-shaped nozzle 23 is longer than the front nozzle lip 26 and slides on the surface of the printing screen 2. The length 1 of the slit-shaped nozzle 23 is smaller than the length L of the scraper 21 in order to ensure that the printing ink is sucked away only in the region in which the scraper 21 has scraped off the printing ink on the printing screen.

The slit-shaped nozzle 23 may be mounted to the same mounting support on which the scraper 21 is disposed, so that the scraper and slit-shaped nozzle are simultaneously guided at a constant spacing over the printing screen. The slit-shaped nozzle 23 is connected to a collecting pipe 27 which is in turn connected by one or more pipe stubs 28 and hoses to a suitable suction pump.

The solvents and diluting oils of the printing inks evaporate especially rapidly under the action of the suction air stream. This can result in the viscosity of the printing ink in the suction air stream rapidly increasing, and the dried printing ink residues sticking to the inner wall faces of the slit-shaped nozzle. In the course of time, the cross-section of the slit-shaped nozzle may be reduced and the suction power of the nozzle decreased, so that a complete removal of the printing ink residues from the printing screen is thereby made difficult.

In order to prevent the printing ink residues from drying onto and clogging the inside of the suction nozzle, diluting oil or a solvent may be fed at a low rate directly to the suction air stream during the suction operation. In this way, not only is it possible to prevent printing ink residues from adhering inside the nozzle, but already dried-on ink residues inside the nozzle can again be liquefied and sucked off. In the feeding of diluting oil or solvent to the suction air stream, however, care should be taken that the surface of the printing screen does not come into contact with the diluting oil or solvent. Otherwise, undesired changes in the printing ink could occur.

A device which has proved successful for the feed of diluting oil or solvent into the suction air stream is illustrated in FIG. 5. On the rear wall of the slit-shaped nozzle 23, a distributor pipe 29, extending across the entire width of the slit nozzle, is disposed somewhat above the nozzle lip 25 sliding on the printing screen 2. The distributor pipe 29 is provided with a feed line 30 for the supply of diluting liquid. The distributor pipe 29 and the lip 25 of the slit-shaped nozzle are provided with a series of bores 31 through which the diluting oil (or solvent) issues from the distributor pipe 29 and can be entrained by the suction air stream. The bores 31 may, for example, be disposed at horizontal intervals of 10 to 30 mm and each have a diameter of about 1 mm. The flow rate of diluting oil can be regulated by a (not illustrated) throttle valve disposed in the feed line 30. As diluting oil or solvent, those liquids which serve as diluents for adjusting the viscosity of the printing ink have proved satisfactory.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of applying a decorative coating onto a glass pane, comprising the steps of:

positioning a printing screen on a glass pane to be coated such that at least a portion of the printing screen extends beyond a peripheral face of the glass pane;

printing a decorative coating onto the glass pane by applying a printing ink through the printing screen;

applying a pneumatic pressure differential across at least the portion of the printing screen extending beyond the peripheral face of the glass pane so as to remove printing ink from meshes of the printing screen, wherein said applying step comprises applying suction to said printing screen through a nozzle substantially simultaneously with said printing step; and introducing a printing ink solvent or diluent separate from the printing ink into said nozzle during said applying step.

2. The method of claim 1 wherein said applying suction comprises sucking air through the printing screen via said nozzle at a side of the printing screen opposite that in contact with the glass pane.

3. The method of claim 1 wherein said printing step comprises moving a printing scraper across said printing screen and said applying step comprises moving the suction nozzle across the printing screen immediately behind said scraper and parallel thereto.

4. The method of claim 2 wherein the air is sucked upwardly.

5. An apparatus for applying a decorative coating to a glass pane, comprising:

a table onto which a side of a glass pane to be coated may be laid;

a printing screen which may be laid on the other side of a glass pane lying on the table, the printing screen having such a size as to extend beyond a peripheral edge of the glass pane lying on the table;

a printing scraper movable across the printing screen for printing a decorative coating on the glass pane lying on the table by forcing a printing ink through meshes of the printing screen;

means for applying a pneumatic pressure differential across at least the portion of the printing screen extending beyond the peripheral edge of the glass pane so as to remove printing ink from the meshes of the printing screen, wherein said applying means comprise a suction nozzle movable with said printing scraper and positioned adjacent said printing screen when said printing scraper moves across said printing screen; and means for feeding a printing ink solvent or diluent separate from the printing ink into said nozzle.

6. The apparatus of claim 5 wherein said nozzle is slit-shaped and has a length less than a length of said scraper.

7. The apparatus of claim 5 wherein said suction nozzle is connected to said scraper.

8. An apparatus for applying a decorative coating to a glass pane, comprising:

a table onto which a side of a glass panel to be coated may be laid;

a printing screen which may be laid on the other side of a glass pane lying on the table, the printing screen having such a size as to extend beyond a peripheral edge of the glass pane lying on the table;

a printing scraper movable across the printing screen for printing a decorative coating on the printing screen lying on the table by forcing a printing ink through meshes of the printing screen;

means for applying a pneumatic pressure differential across at least the portion of the glass pane extending beyond the peripheral edge of the glass so as to remove printing ink from the meshes of the printing screen, wherein said applying means comprise:

a depression in said table and positioned such that at least a portion of the depression extends beyond the peripheral face of the glass pane lying on the table; and a source of positive air pressure connected to said depression such that air is blown through the meshes of said printing screen.

* * * * *